United States Patent [19]

Bagen et al.

[11] 3,934,501

[45] Jan. 27, 1976

[54] ALIGNMENT AND ACTUATING MECHANISM FOR MICR DOCUMENT ENCODING APPARATUS

[75] Inventors: Herbert John Bagen; Ronald Worden Ferguson; Henry M. Korytkowski, all of Rochester; William H. Mowry, Jr., Ionia, all of N.Y.

[73] Assignee: Burroughs Corporation, Detroit, Mich.

[22] Filed: Dec. 20, 1974

[21] Appl. No.: 534,748

Related U.S. Application Data

[63] Continuation of Ser. No. 412,780, Nov. 5, 1973, abandoned.

[52] U.S. Cl. ..... 101/93; 101/407 R; 197/135 R

[51] Int. Cl.[2] ..... B41J 13/12

[58] Field of Search ..... 197/127 R, 135 R; 101/100, 101/DIG. 3, 93, 407 R

[56] References Cited

UNITED STATES PATENTS

| | | | |
|---|---|---|---|
| 1,369,934 | 3/1921 | Onstad | 101/DIG. 3 |
| 2,819,671 | 1/1958 | Porter, Jr. et al. | 101/DIG. 3 |
| 2,880,669 | 4/1959 | Hirschey | 101/35 |
| 3,581,862 | 6/1971 | Sandrone et al. | 197/135 R X |
| 3,659,521 | 5/1972 | Lany | 101/35 X |
| 3,684,076 | 8/1972 | Crain et al. | 197/127 R |
| 3,712,211 | 1/1973 | Thut | 101/100 X |

*Primary Examiner*—Clifford D. Crowder
*Attorney, Agent, or Firm*—Carl Fissell, Jr.; Edward J. Feeney, Jr.; Kevin R. Peterson

[57] ABSTRACT

A demountable document receiving tray or gauge member is provided with means for adjusting the lateral location of a document relative to the printing position of a MICR imprinting apparatus so as to position the document at any one of a multiple set of full field MICR printing positions. Structure operably associated with the document receiving tray permits automatic actuation of the MICR printing mechanism by insertion of a document. Also included is structure providing a time delay preventing accidental actuation of the document printing structure after withdrawal of the document.

5 Claims, 14 Drawing Figures

ALIGNMENT AND ACTUATING MECHANISM FOR MICR DOCUMENT ENCODING APPARATUS

This is a continuation of application Ser. No. 412,780, filed Nov. 5, 1973, now abandoned.

BACKGROUND OF THE INVENTION

The present invention relates to automatic alignment and actuating apparatus for business machines of the type capable of printing both numerical and symbol information onto a document for subsequent handling by automatic character recognition equipment.

Banking documents of the type with which the present invention is most useful are usually encoded along the lower bottom edge portion in the so-called clear band area of the document, e.g. check, with magnetic ink character recognition (MICR) numbers and symbols in accordance with the requirements of the American Banking Association. On a check, for example, the numbers and symbols are or may be placed in four different locations called "fields" along the aforementioned clear band. These four fields are designated (auxiliary "on-us"), (transit number), (on-us) and (amount). The first three fields are usually preprinted when the checks are supplied to a customer with the amount field being filled in during a posting operation.

Many times a check will enter the automatic sorting and handling apparatus without the MICR encoding. These checks, which are commonly referred to as "exception items", must then be processed so that they will flow through the automatic equipment with a minimum amount of handling and expense.

Another source of such exception items are new checking accounts. When a checking account is opened, the band ordinarily provides 5 or 10 checks for use until the customer receives a supply of personalized pre-encoded checks. Each time the customer uses one of these temporary checks, it must be handled as an exception item by the bank. The bank must encode each of the checks with automatic MICR numbers and symbols to enable the checks to be processed automatically. Ordinarily the banks suffer this expense for the goodwill of the customer, however, these checks present an expensive and time consuming handling problem.

The present application is related to U.S. Pat. No. 3,712,211, entitled "Alignment Means for a Bed and Platen Printing Machine", filed Oct. 30, 1970, Ser. No. 85,445 issued Jan. 23, 1973, in the name of Paul J. Thut.

SUMMARY OF THE INVENTION

The present invention which is an improvement over the aforementioned patented MICR encoding apparatus relates to means for automatically aligning a document adjacent to a MICR printing position and simultaneously actuating the MICR printing apparatus to print the MICR encoded information on the aligned item. The apparatus includes oppositely disposed switch means against which the lower edge of the item must abut and an edge alignment switch carried by the document tray against which the vertical edge of the item must also abut. The three switch means operate conjointly thereby to prevent accidental "cocking" or misalignment of the item adjacent to the printing station. The item receiving and holding tray or gauge member is provided with a laterally adjustable item receiving throat permitting the item to be encoded with MICR information in any selectable one of four recongnized MICR encoding fields. The electrical switching of the apparatus is provided with time delay means preventing accidental misalignment and inopportune actuation of the printing mechanism until a preset time has elapsed after any individual printing operation.

The present invention permits the MICR encoding apparatus to be automatically actuated and cycled upon the entry of the item and its alignment within the item receiving throat of the device.

This invention also permits the selective choice of multiple MICR encoding fields by simply laterally repositioning the item receiving throat portion of the item carrying tray while automatically adjusting the lateral contact switch means.

The present apparatus provides highly accurate registration and alignment of the MICR printing to the extent that repeated actuation of the printing mechanism without removal of the item is undetectable to the human eye.

The present apparatus is automatically cyclicable without operator intervention with respect to keyboard controls.

The invention, both as to its organization and method of operation, together with further objects and advantages, will be best understood by reference to the detailed description taken in conjunction with the accompanying drawings.

The invention will be described in conjunction with a preferred embodiment. However, it should be understood that it is not intended to thereby limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
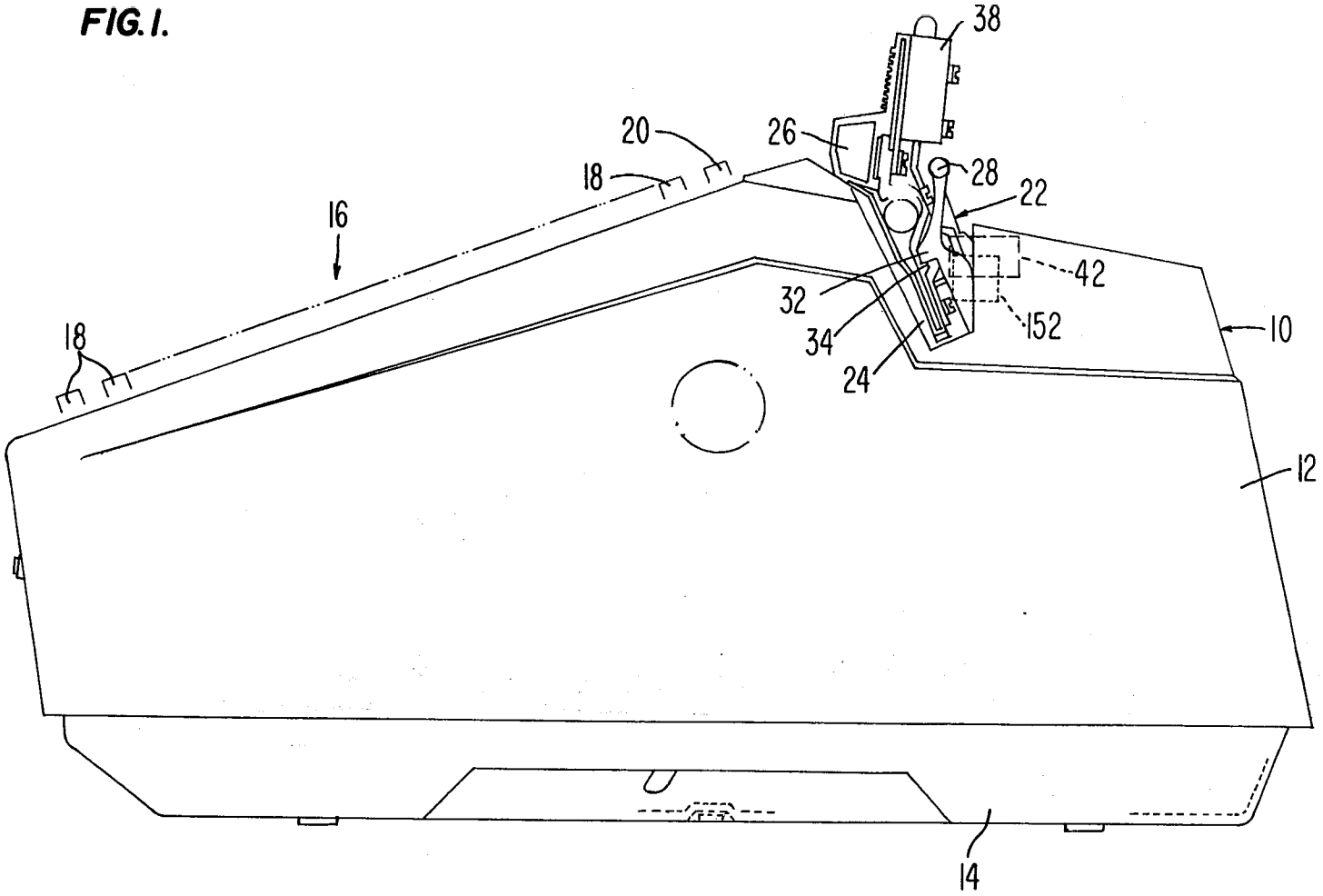
FIG. 1 is a side elevational view of the right hand side of the MICR encoding apparatus showing the document receiving tray or gauge member in place.

Referring to FIG. 1, a document encoding machine of the type described and claimed in U.S. Pat. 3,712,211 assigned to the same assignee as the present invention and modified in accordance with the present invention is indicated generally at 10. The machine has a cover 12 and a base 14. A keyboard indicated generally at 16 is located on the sloping forward front portion of the machine. The keyboard has a plurality of number and symbol keys 18 which are divided into individual keybanks. The keyboard also has a repeat bar 20 for reencoding the same information on several documents. A clear bar (not shown) adjacent to the repeat bar is provided to manually clear the keyboard.

Above the keyboard and in clear view of the operator is a window (not shown) through which the operator can observe a signal flag which indicates to the operator that only a relatively small amount of inking ribbon remains on the supply spool and that the end of the ribbon is approaching.

A removable document receiving and holding tray 22 referred to as a gauge member in U.S. Pat. No. 3,712,211 is mounted within a recess 24 across the top portion of the machine 10. The holder 22 has a laterally movable tab stop switch actuator member 26 for aligning the document to be printed relative to the print wheels in the machine. A window (not shown) in the document holder indicates to the operator the field in which the document is being encoded and the location of the resultant printing relative to a clear band portion along the lower edge of the document.

Figure 2:
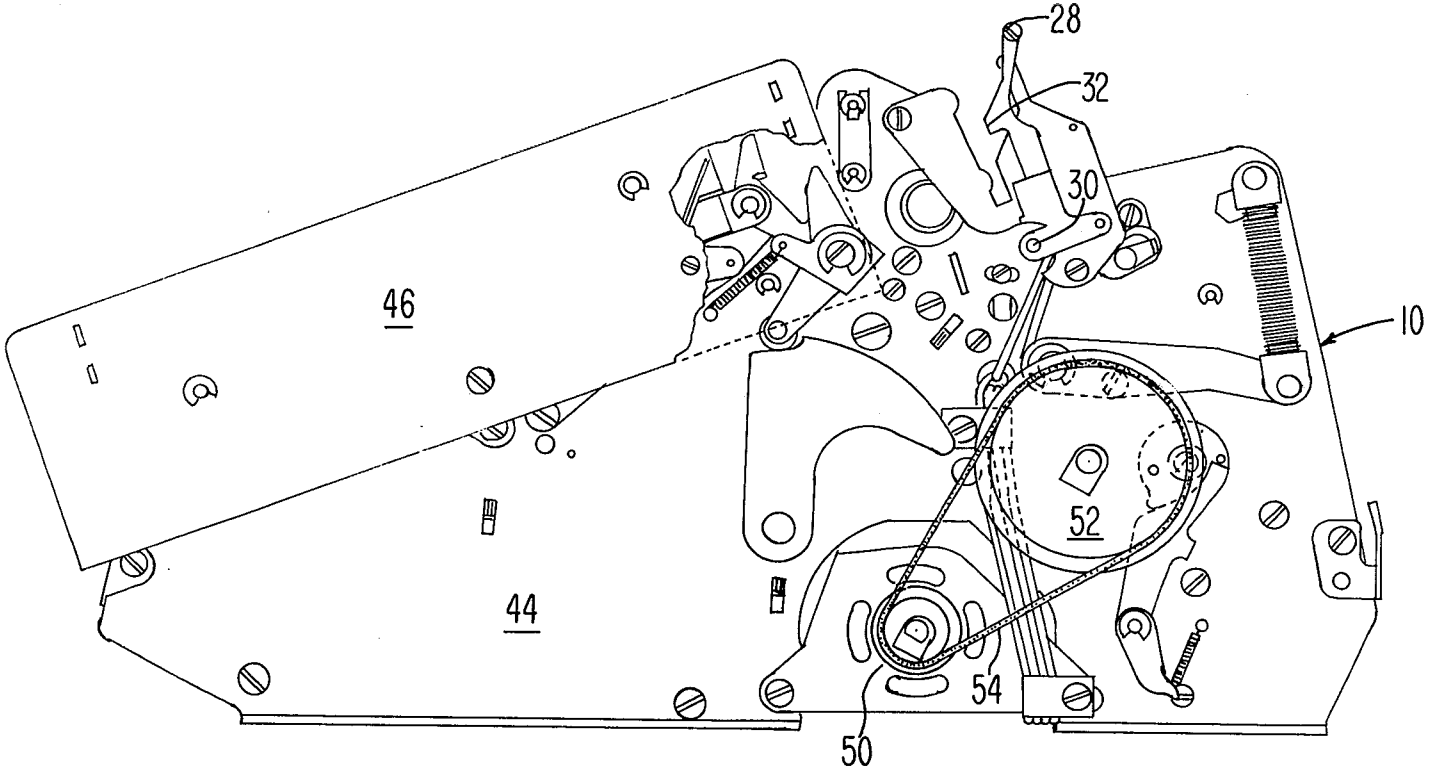
FIG. 2 is a view similar to that of FIG. 1 of the same side of the machine with the cover removed and with the document receiving tray dismounted.

The document tray 22 is retrained in operating position within the machine by a spring biased bail 28 which is pivotally mounted on the side frames of the machine as at 30, FIG. 2. The bail 28 has a projecting portion 32 which cooperates with a surface 34 on the tray 22 to retain the tray in the machine. When it is desired to remove the tray 22 from the machine, for example, to place a new inking ribbon in the machine, the bail 28 is pushed toward the rear of the machine allowing tray member 22 to be lifted vertically clear of the machine.

Secured to the rear upper exposed portion of tray 22 and operably associated with movable tab 26 is an adjustably, positionable snap-action switch 36, FIGS. 12 and 14, adapted to be actuated by the edge of a document, as will be explained later on herein. The switch actuating members for switch 36 are enclosed by cover member 38. Electrical leads 40, FIG. 14, from the switch 36 are fed to a junction block 42 secured to the tray 22 permitting the same to be easily and efficiently, eletrically and mechanically dismounted.

in FIG. 2, the right hand side of the machine 10 (as viewed from the front) is shown with the cover 12 removed for observation of the working parts. In the description which follows, a part will be biased forward when it is drawn toward the front of the machine and rearward when it is drawn toward the rear or back of the machine.

Figure 3:
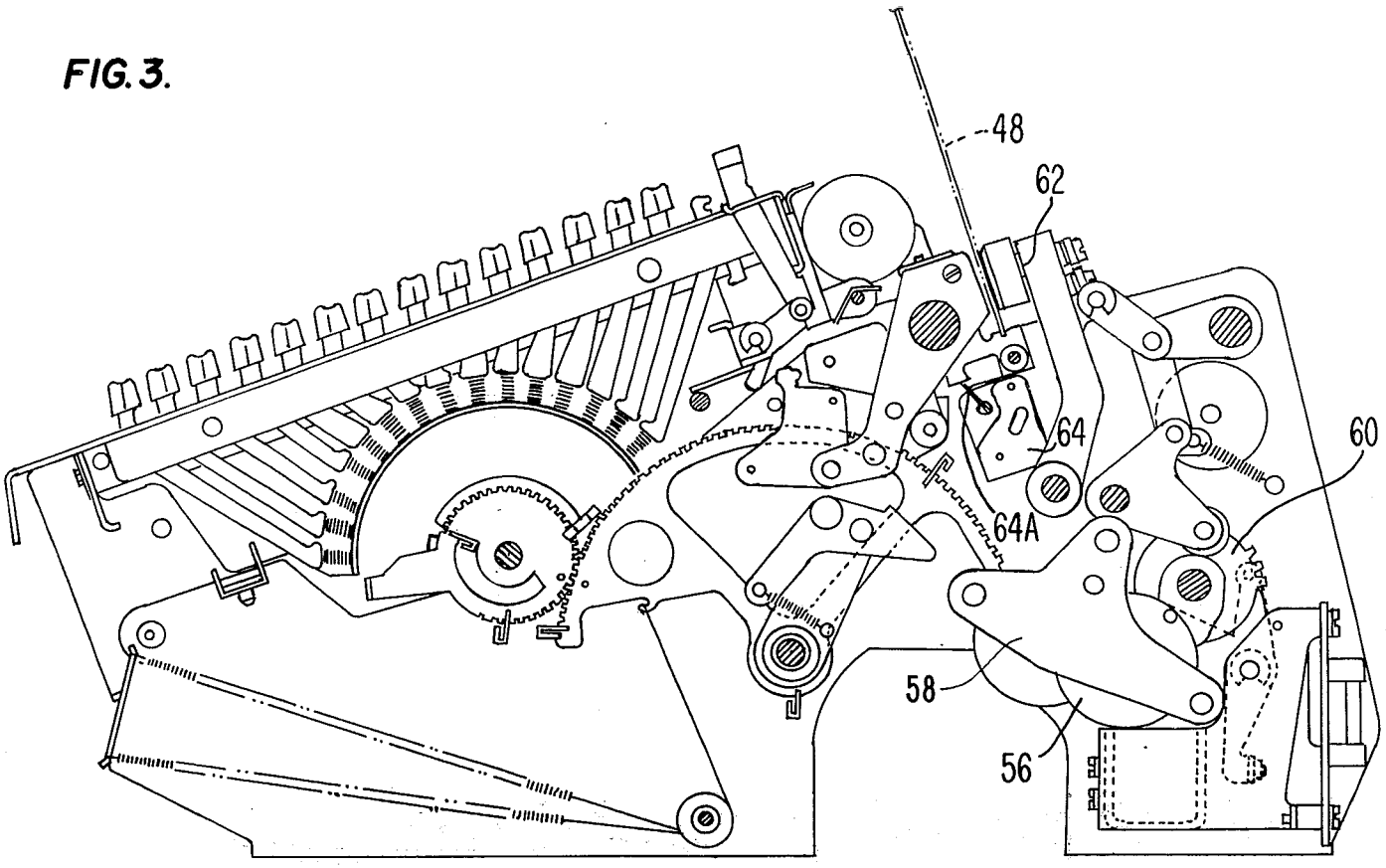
FIG. 3 is an elevational view similar to FIG. 2 with the right hand side plate removed to expose the key actuating mechanism and the switch camming means of the invention.
Figure 4:
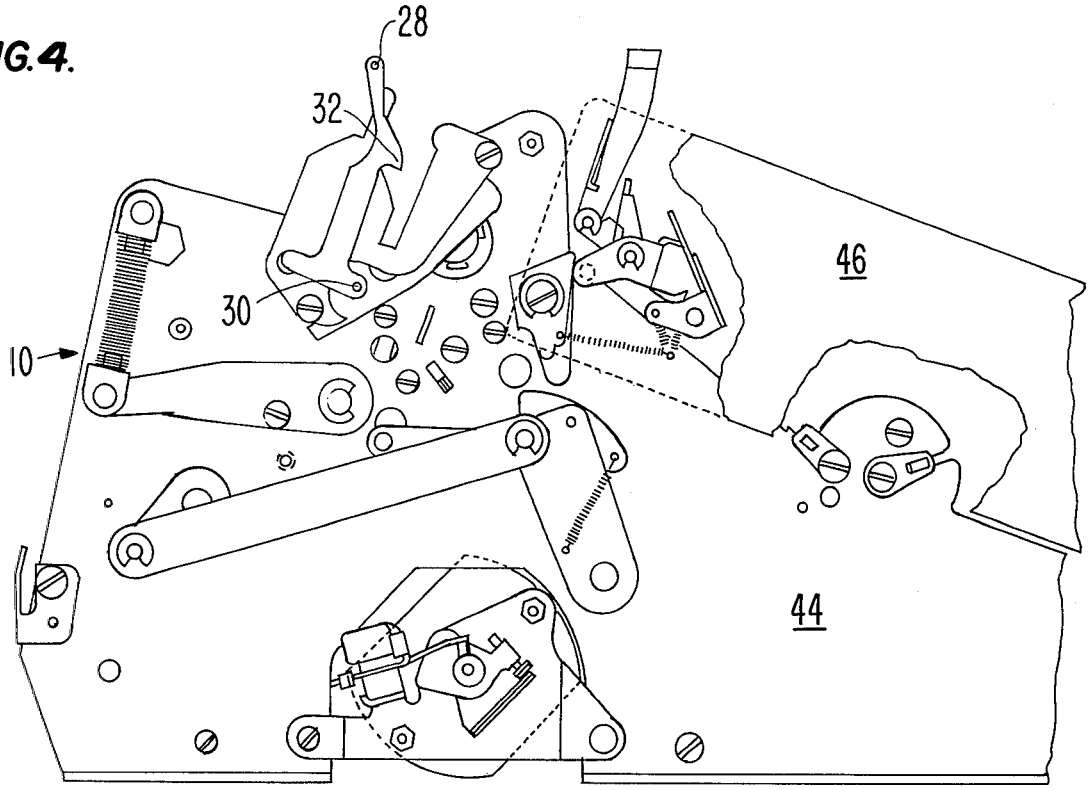
FIG. 4 is a left hand side elevational view of the machine with portions broken away to expose various electrical contacts and mechanical subassemblies.
Figure 11:
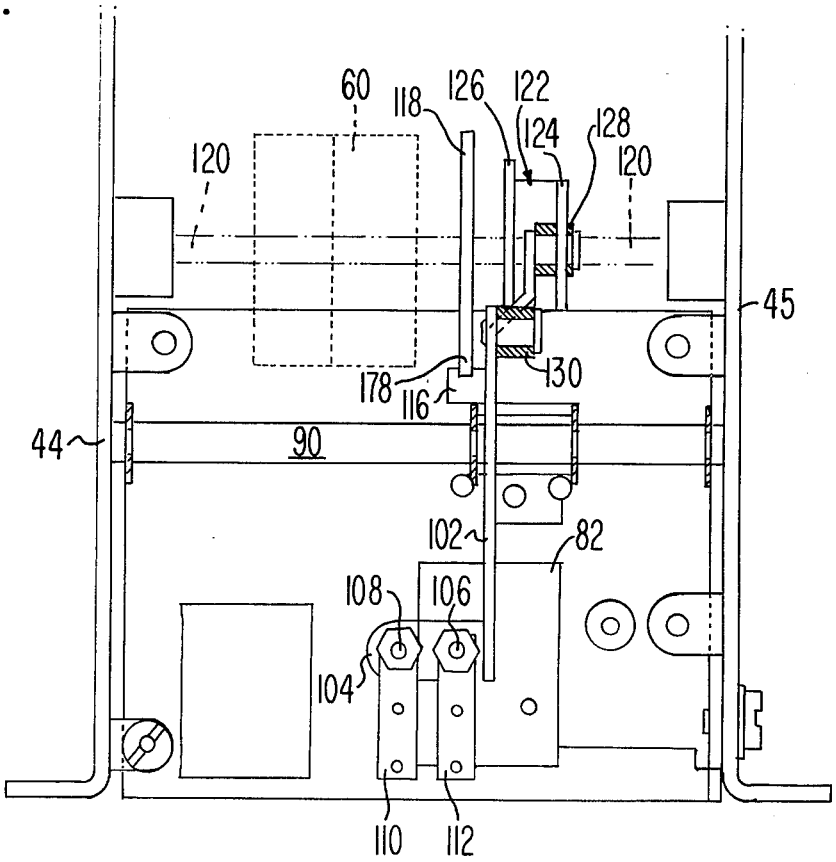
FIG. 11 is a rear elevational view of the mechanism of FIG. 10.

The machine has right and left side frame members 44 and 45, FIGS. 2 and 11, made of heavy gauge steel and a lighter gauge steel right hand keyboard support frame 46, FIG. 2, only one of the two frames being shown in FIG. 2. When a document, e.g. check 48, FIG. 3, is present and properly positioned in the tray member 22, a series of electrical and mechanical interlocks are automatically actuated permitting the machine to cycle so as to cause the check to be printed with appropriate MICR information in the selected field. These interlocks include electrical and mechanical apparatus as will be described in detail hereinafter.

Figure 5:
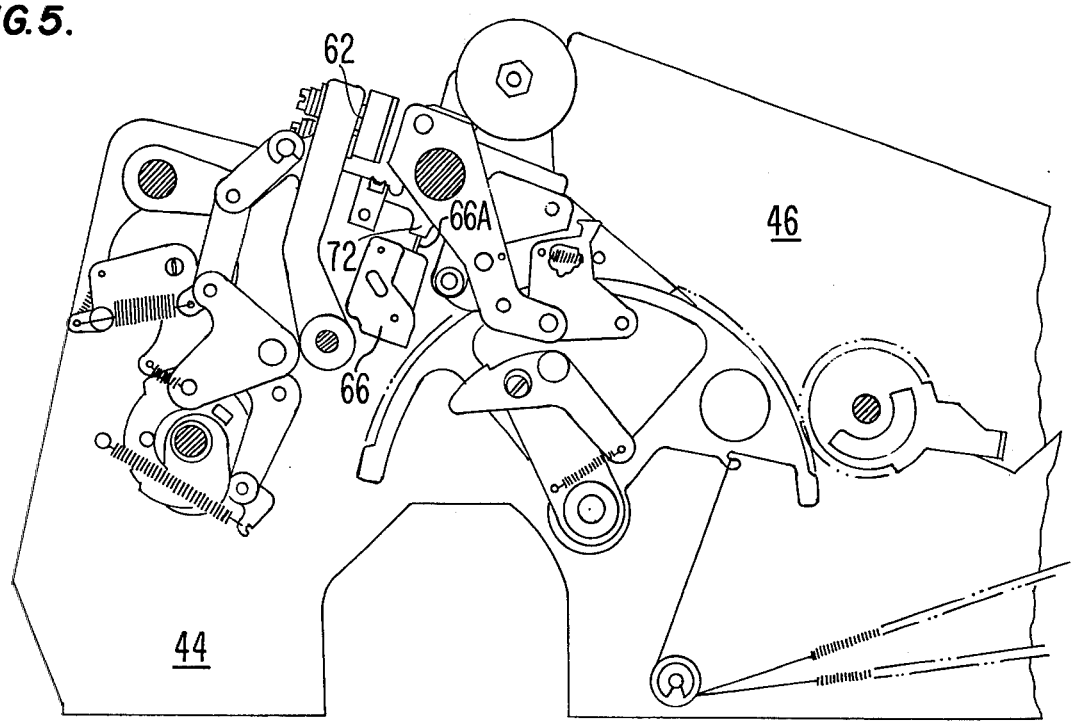
FIG. 5 is a left hand side elevational view illustrating the platen actuating mechanism and the control switching apparatus.

The subject apparatus, as seen in FIG. 2, is electrically operated by means of a drive motor 50 located in the rear lower portion of the machine. Motor 50 is coupled to a large drive pulley 52 through a notched drive belt 54. A gear train 56, FIG. 3, carried by a pair of irregularly shaped brackets 58 (only one of which is shown) is rotatably engaged with a rotary overrunning clutch 60. Clutch 60 is driven by drive pulley 52 through a gear train (not shown). Motor 50 is adapted to be cycled automatically, intermittently by insertion of a document or an item 48, e.g. check into the document receiving throat of tray 22. To this end, there is disposed on opposite sides of frame 44 and 45 of the machine, forwardly of the printing platen assembly 62, two adjustably positionable snap-action switches 64 and 66, FIGS. 3 and 5. The method of adjusting snap-action switches 64 and 66 is as follows: Switches 64 and 66 are fastened integrally with switch brackets 194 which allow switch actuators 64A and 66A to line up with projecting arm 72 through lateral tang 72A. The switch brackets 194 are fastened adjustably to frame 44 and 45 of the machine, by means of slotted holes 198 and screws 200 pivoted about screw 202 attached to side frames 44 and 45. By pivoting the switch bracket assemblies 196, the switch actuators 64A and 66A can be positioned to allow the switch actuating position to be changed. This adjustment allows both switches 64 and 66 on both side frames to be actuated or tripped at precisely the same time. This adjustment insures a document registration in the vertical plane of 0.025 ± 0.010 inches. The actuators 64A and 66A of switches 64 and 66 are adapted to extend vertically upwardly into the path of movement of oppositely disposed document sensing switch actuating interposer members 68, FIG. 8.

Interposers 68 are each provided with three projecting members; a forwardly projecting arm 70, a downwardly projecting arm 72 and a rearwardly projecting arm 74. The interposer 68 is pivotally mounted for rocking movement on the MICR symbol wheel shaft 78 which carries symbol wheels 80 used for printing the MICR symbols on the items as will appear more clearly hereinafter.

The fowardly extending arm 70 of each interposer 68 acts as a counterbalance for the mechanism and its extreme forward end abuts a stop member 76. The rearwardly extending interposer arm 74 is arranged to extend into the path of movement of the document which is receivable in the document receiving tray 22. The document tray is received over the switch actuators and is retained in place by the upper edges of the vertical side frame members 44 and 45, FIG. 11. The lower portion of the tray is notched or cut away (not shown) so that the document can extend below the bottom edge of the tray through the notched opening and into contact with the upper edges of the interposer arms 74 (when the tray is in place in the machine).

Figure 8:
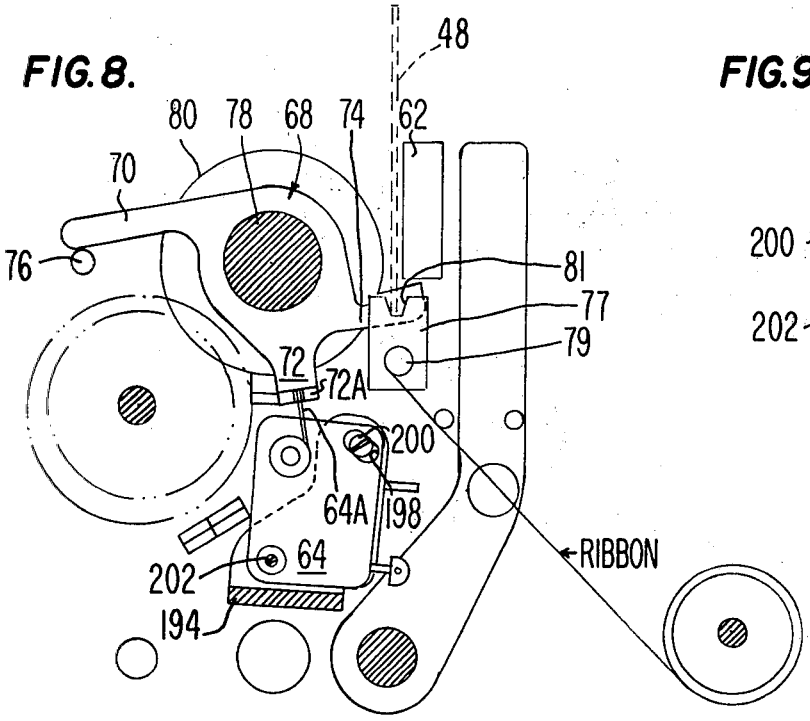
FIG. 8 is a side elevational view partially in section of the mechanism of FIG. 7 but including the ribbon spool, ribbon path and print actuating mechanism.
Figure 9:
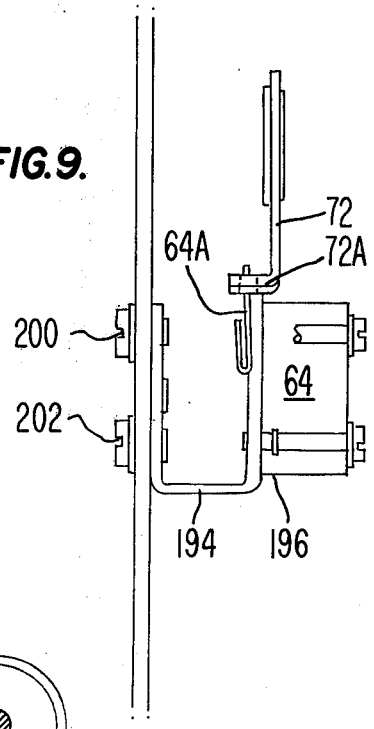
FIG. 9 is a rear elevational view partially in section of the switch mechanism of FIG. 8.

A center bottom document support 77 rockably pivoted on shaft 79 extending between side frames 44 and 45 is disposed beneath the document tray 22 so as to be located within the notch or cutout area of the document tray when the latter is in place in the apparatus. Member 77 forms a document bottom limit member providing support for the otherwise flimsy paper document intermediate the two oppositely disposed interposer arms 74. As seen in FIG. 8, the upwardly projecting edge of arm 74 in its rest position is angled slightly with respect to the V-shaped notch 81 in the document support 77. This arrangement permits the document to strike the arm 74 depressing this member and thereafter bottoming in the V-notch 81 of the support 77. This clockwise movement of member 74 about shaft 78 causes member 72 to move the switch actuators 64*a* and 66*a*, the latter extending upwardly through holes in the lateral tang 72*a*, FIG. 9, of each arm 72, closing and energizing these snap-action switches for purposes to be explained presently.

Figure 10:
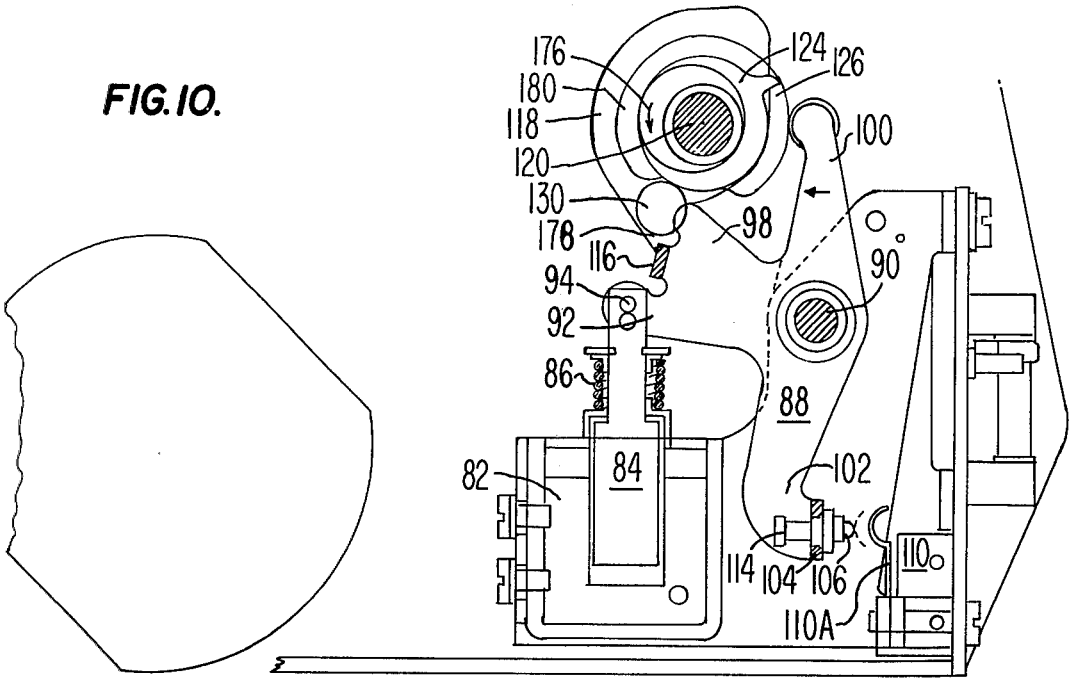
FIG. 10 is a side elevational view partially in section of the automatic trip lever actuating mechanism.

As seen in FIGS. 10 and 11, adjacent to gear train 56 and clutch mechanism 60 is a trip lever actuating solenoid 82 provided with a vertically reciprocable plunger 84 which is spring biased by spring 86 in a downward or a retracted position. A four armed trip lever switch actuating means 88 is rockable about pivot shaft 90 extending between side frames 44 and 45. The left forwardly extending arm 92 (FIG. 10) is pivotally linked to the solenoid plunger 84 by means of a pin 94 and provides means for rockably moving switch trip lever 88 about shaft 90. Intermediate arm 98 and vertically projecting arm 100 provide means to maintain certain of the switch means activated as well as providing a positive return means for the solenoid plunger 84 in case the spring 86 should fail or jam.

Lower depending arm 102 of trip lever 88 carries a transverse tang 104 extending normal to the plane of the drawing provided with a pair of contacts 106 and 108 only one of which is shown in FIG. 10. As seen in FIG. 11, disposed to the rear of the contact carrying arm 102 of the trip mechanism, are two "non-repeat" snap-action switches (NRSW1 and NRSW2) 110 and 112, respectively. The actuator 110a of switch 110 projects leftwardly (FIG. 10) into the path of movement of the switch contact 106. Each switch contact is adjustable by means of set screw 114 to control any overtravel with respect to the trip switches.

Intermediate the arms 92 and 98 on trip lever arm 88 is a projecting tang 116 which operates in conjunction with clutch trip cam 118 on main cam shaft 120 to cause the clutch mechanism 60 to engage and drive. This permits the drive motor 50 to cycle the apparatus causing it to print the desired MICR symbols on the item disposed within the document tray 22 in the manner described in U.S. Pat. No. 3,712,211. Mounted adjacent to cam 118 on shaft 120 is a cam assembly 122 including a kick-off cam 124 and a switch holding cam 126. Kick-off cam 124 operates in conjunction with follower roller 128 to return the solenoid plunger to its inactive rest position should the spring 86 fail or the solenoid itself hang-up for some inexplicable reason. Cam 126 operating in conjunction with follower roller 130 acts to maintain snap-action switches 110 and 112 actuated for purposes still to be described.

Figure 12:
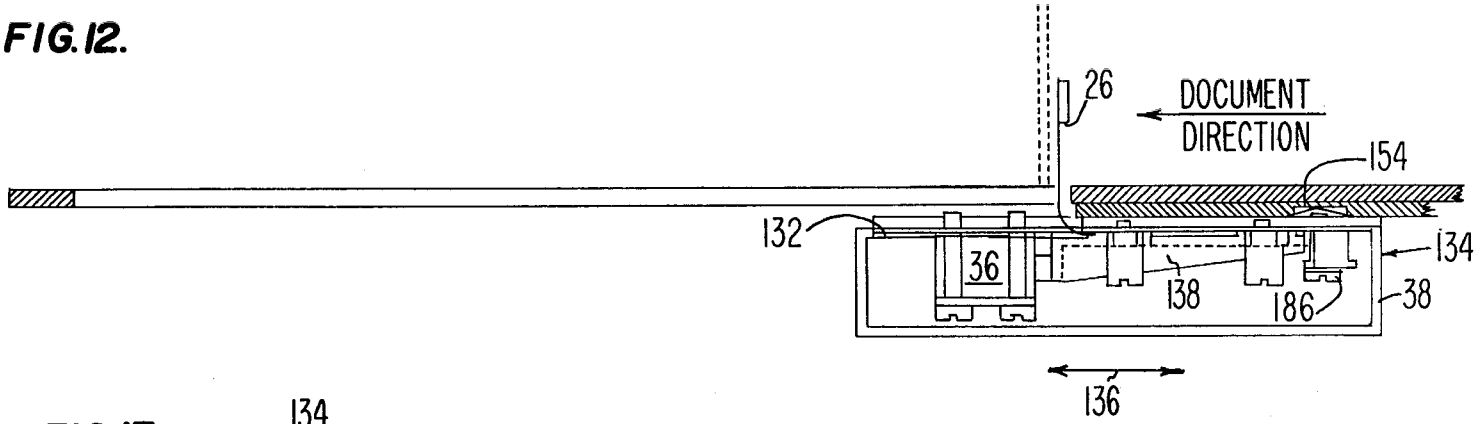
FIG. 12 is a top plan view partially in section of the document receiving tray end stop switch mechanism.
Figure 14:
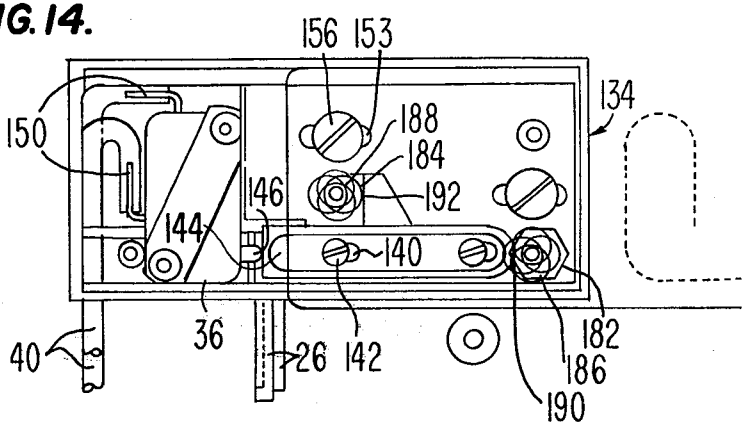
Figure 13:
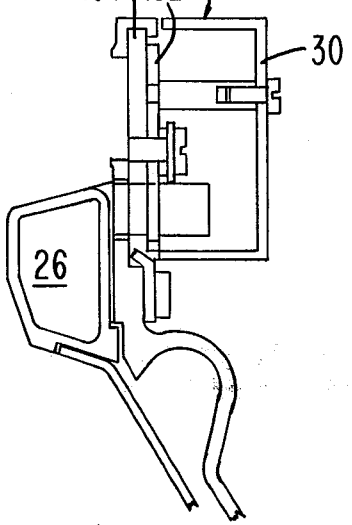
FIG. 13 is an elevational view of the left end of the document guide tray of FIG. 12; and, FIG. 14 is a detail view of the document end stop switch of FIG. 12 with the cover removed to expose the interior to view.

With particular reference to FIGS. 12 through 14, inclusive, of the drawings, it is seen that snap-action switch 36 is secured as by bolts within the rectangular box-like structure formed by cover 38 and base 132 to which the cover is secured. This assembly 134 is longitudinally slidably, adjustably, movable in the direction of the double headed arrow 136 so as to permit MICR printing of the item in any desired one of a number of field positions located along the lower border or band of the item. The actuating tab stop member 26 is a substantially "L" shaped non-conductive plastic formed or molded piece, the tab stop portion of which is exposed to the operator as seen in FIGS. 12 and 13 to form a lateral or transverse abutment or stop against which the check item is received. The concealed portion 138, integral with the tab stop member, is mounted to the base 132 by means of slotted holes 140 and bolts 142. The leftward end 144 (as viewed in FIG. 14) of member 138 forms an operating contact surface for the switch actuator 146 of switch 36. The longitudinal movement of concealed portion 138 is adjustably limited by two eccentric sleeves 182 and 184 and locked into position by screws 186 and 188. When eccentric 182 is secured in place by screw 186 against surface 190 of concealed portion 138, the rightward movement of 138 is limited. In the same manner, when eccentric 184 is secured in place by screw 188 against surface 192 on extended tab of concealed portion 138, the leftward movement of 138, which is integral with the tab stop member 26 is limited. With the above two adjustments the travel of switch actuator 146 can be limited precisely to a minimum, producing consistent printing accuracy on the document, within ±0.010″. Electrical switch contact leads 40 are brought out from a switch contacts 150 to the pluggably demountable junction block 42, FIG. 1, for interconnection to a fixed receptacle 152 secured to the machine frame in known manner. The assembly 134 is adjustably mounted to a transverse slide member 154 as by bolts 156 through elongated holes 153 for movement leftwardly and rightwardly of the printing position for purposes previously described.

The operation of the present invention, with reference to circuit diagram FIGS. 6, 8, 10 and 11 is simple, fast and efficient. The operator first inserts the exception item 48 FIG. 3 to be MICR encoded into the throat of the document receiving tray 22 FIG. 1 so that the item bottoms against the rearward arm 74 of the document sensor interposer arm 68, FIG. 8, rotating the interposer and closing item trip switches 64 and 66. As the document is slid rightwardly in the tray to complete the insertion movement (leftwardly as viewed in FIG. 12) its rightward edge abuts the tab stop 26, FIGS. 1, 12, 13 and 14 energizing document trip snap-action switch 36. This conjoint switch action energizes solenoid 82, FIGS. 6, 10 and 11, from a source of B+ over lines 160 and 162 through fuse 163. Energization of solenoid 82 rocks trip lever actuating mechanism 88, FIG. 10, counterclockwise from the full to the dotted line position causing arm 102 to contact and close non-repeat switches 110 and 112.

Tang 116 of the lever arm 88 is withdrawn from the clutch trip cam lobe 178 permitting the clutch to rotate. Cam 126 and its enlarged cam lobe 180 engages and moves follower roller 130 from the full to the dotted line position maintaining switch arm 102 rightwardly holding switches 110 and 112 closed. Solenoid 82 is now out of the circuit and the switches are controlled by the cam action of arms 98 and 100 (switch trip lever 88). Non-repeat switch 110 initiates a time delay for engagement and actuation of clutch 60 through time delay circuit including diode 164, resistance 166, capacitance 168, time delay relay coil 170 and contacts 170*a* and 170*b*. Non-repeat switch 112 applies electrical potential (B+) through fuse 172 and speed regulating switch 174 to drive motor 50. Energization of motor 50 engages the clutch ratchet (not shown) of clutch 60 causing a print cycle to take place and MICR printing to be applied to the item.

At this point in time as seen in FIGS. 10 and 11 trip cam 124 moves in the direction of arrow 176. With solenoid 82 out of the circuit non-repeat switches 110 and 112 are energized and are controlled mechanically through trip cam 124. At the completion of the time delay cycle non-repeat switches 110 and 112 open, non-repeat switch 112 shuts off the motor. The relay 170 stays energized through the trip switches preventing a repeat cycle.

Figure 6:
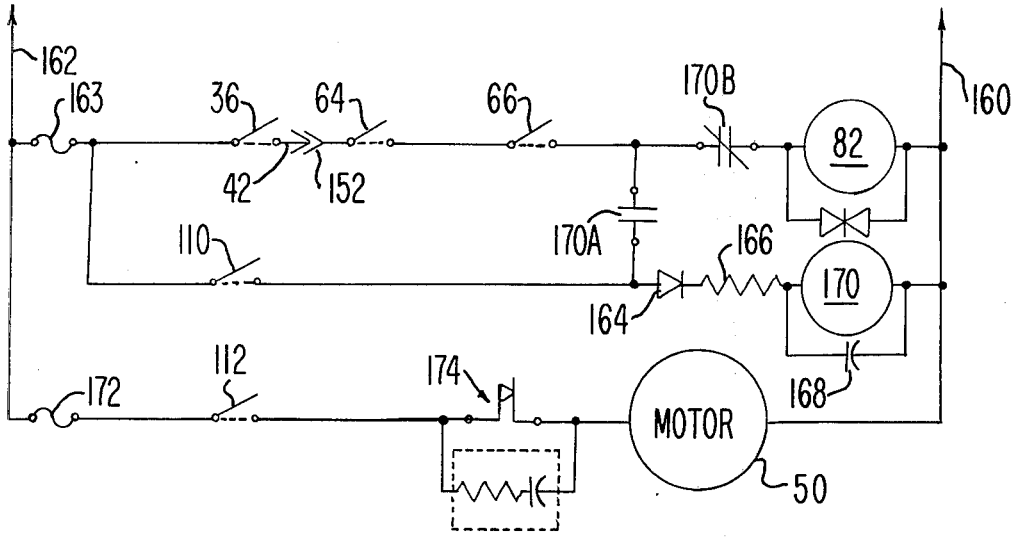
FIG. 6 is a schematic wiring diagram for the present invention.
Figure 7:
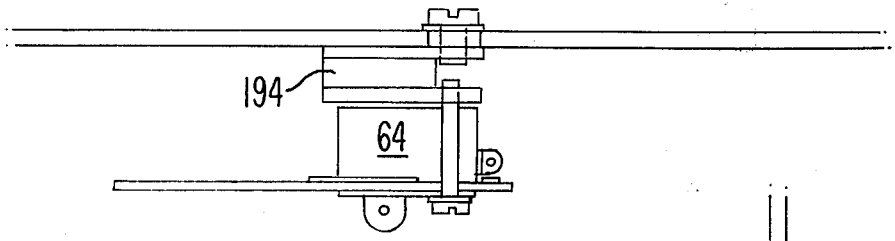
FIG. 7 is a top plan view partially in section of the document bottom edge switch mechanism.

The time delay mechanism employs an RC circuit FIG. 6 across the time delay relay coil 170. Since a DC coil is used the diode 164 is employed to provide half-wave rectification while resistance 166 introduces a time constant to charge capacitance 168. When capacitance 168 charges up to the pick or energization voltage of relay 170, relay coil 170 is energized opening up closed contact 170*b* of the solenoid circuit energizing relay 170 through the document trip switches 36, 64 and 66 and closed contact 170*a*. Thus if a document is left in the tray 22 accidentally or otherwise relay 170 remains energized and there is no way to trip or actuate the machine drive until or unless the document is removed.

Now the machine completes its cycle. Kick-off cam 124 rotates far enough to permit the lever 88 to rock clockwise moving arm 100 rightwardly FIG. 10 opening switches 110 and 112 removing power to motor 50. This interrupts the alternate power circuit to time delay relay 170 but the relay is still held in by virtue of the document trip switches. Removal of the document starts the time delay to prevent accidental tripping of the machine. At the end of the time period relay 170 is deenergized permitting a new cycle of operation.

What is claimed is:

1. Control apparatus for printing devices comprising:

printing means for printing MICR encoding on an item such as a check, demountable, removable item receiving means receivable in said printing means for positioning an item adjacent to the printing mechanism of said printing means, electrical signal means in said item receiving means for producing a signal signifying the item is accurately side edge aligned within said receiving means, additional electrical signal means within said apparatus effective to produce a signal signifying the item is properly bottomed relative to said printing mechanism, electromagnetic means including means actuatable in response to the signals from said first and second mentioned signal means for actuating means for preventing cycle repetition and for printing upon said item, said printing means including cam means for controlling and terminating the printing cycle of said apparatus and, electrical time delay circuit means interconnecting the first and second mentioned signal means and said means preventing machine cycling for preventing a second or unwanted printing on said item.

2. The invention in accordance with claim 1 wherein said time delay circuit means includes a diode and resistance electrically coupled to a capacitance across a relay coil effective to deenergize said electromagnetic means preventing premature machine cycling in response to operator action.

3. The invention in accordance with claim 1 wherein said additional electrical signal means are provided with eccentric means enabling the actuators of said signal means to be adjusted effective to control the MICR encoding location within a narrow and precise tolerance range.

4. Control mechanism for printing apparatus comprising;

document receiving and supporting means, first switch means operably associated with said document receiving means and against which said document is side edge aligned, printing apparatus including means demountably, removably supporting said document receiving means, second switch means operably associated with said printing apparatus and against which same document is bottom edge aligned, means operably engagable with said printing apparatus and responsive to conjoint signal output from said first and second switch means to produce an electrical signal indicating said document is properly oriented in said document receiving means for printing, and, means controlling said printing apparatus responsive to said electrical output signal and including cam means for actuating said printing apparatus and causing printing on said document.

5. The invention in accordance with claim 4 wherein said controlling means comprises an electromagnetically reciprocable solenoid and a rockable linkage operably associated with said cam means and said switch means to prevent accidental actuation of said printing apparatus and suitable actuation thereof in response to a properly positioned document.

* * * * *